US005253390A

United States Patent [19]

Gross et al.

[11] Patent Number: 5,253,390

[45] Date of Patent: Oct. 19, 1993

[54] FURNITURE HINGE

[75] Inventors: Jürgen Gross, Enger; Günter Sundermeier; Ulrich Beneke, both of Bünde; Dieter Waltemate, Hillhorst; Detlev Uthoff, Löhne, all of Fed. Rep. of Germany

[73] Assignee: Paul Hettich GmbH & Co., Kirchlengern, Fed. Rep. of Germany

[21] Appl. No.: 820,602

[22] PCT Filed: May 16, 1991

[86] PCT No.: PCT/DE91/00417

§ 371 Date: Mar. 21, 1992

§ 102(e) Date: Mar. 21, 1992

[87] PCT Pub. No.: WO91/18173

PCT Pub. Date: Nov. 28, 1991

[30] Foreign Application Priority Data

May 22, 1990 [DE] Fed. Rep. of Germany ... 9005813[U]

[51] Int. Cl.[5] ..... E05D 7/12

[52] U.S. Cl. ..... 16/257

[58] Field of Search ..... 16/254, 258, 259, 257, 16/DIG. 43

[56] References Cited

U.S. PATENT DOCUMENTS 4,841,598 6/1989 Grass ..... 16/257

4,976,006 12/1990 Lautenschlager ..... 16/257

5,054,164 10/1991 Blanco-Equiluz ..... 16/258

FOREIGN PATENT DOCUMENTS 8907480 8/1989 Fed. Rep. of Germany .

WO87/07672 12/1987 PCT Int'l Appl. .

*Primary Examiner*—Lowell A. Larson

*Assistant Examiner*—Donald M. Gurley

*Attorney, Agent, or Firm*—Peter K. Kontler

[57] ABSTRACT

A hinge for an article of furniture has a mount which is attachable to a wall of the article. A hinge unit including a hinge arm and, optionally, a support for the arm is releasably connectible to the mount. To this end, the hinge unit is provided with a shaft which is receivable in a complementary recess of the mount. The hinge unit is further provided with a resilient tongue, and the tongue has a groove which cooperates with a projection on the mount to lock the hinge unit to the mount by snap action. A lever projects at an angle from both sides of the hinge unit, and the free end of each lever carries an arm which extends towards the tongue. An inclined protuberance is provided on either side of the tongue and each lever arm abuts a respective protuberance. The arrangement is such that, when the levers are urged towards one another, the lever arms cooperate with the protuberances to disengage the groove in the tongue from the projection on the mount.

17 Claims, 3 Drawing Sheets

FURNITURE HINGE

The invention relates to a furniture hinge having a hinge arm which is adjustably situated on a mounting plate and, at two bearing locations spaced along its length, is held on the mounting plate either directly or indirectly via an intermediate part. The hinge arm or intermediate part can be engaged with the mounting plate in a formfitting manner at one bearing location and is held by resilient arresting connection at a the other bearing location.

A furniture hinge of this type is known (German Gebrauchsmuster 89 07 480). To obtain an arresting connection between the intermediate part and the mounting plate, the longitudinal sides of the intermediate part, which part is U-shaped in cross section, are provided with arresting tongues integral with the intermediate part and extending to the rear end of the hinge arm. The resilient tongues are U-shaped in this region and an inner leg of each projects through a slit-like opening in a front plate of the intermediate part. The free legs of the tongues project into an interior compartment of the intermediate part and, upon being placed on the mounting plate, are guided inwards and into an undercut arresting recess of the mounting plate by cooperation with inclined surfaces of the mounting plate. To release the locking mechanism, the tongues are pressed together manually and removed from the region of the undercut surfaces.

This construction of the furniture hinge is expensive to manufacture since the tongues which act as arresting means, and the operating portions of the mounting plate cooperating therewith, must be produced to close tolerances.

It is an object of the invention to design a furniture hinge of the type mentioned at the outset in such a manner that it is structurally simple, economical to manufacture and has little susceptibility to trouble during operation.

In the hinge of the invention, only one resilient tongue is provided and is arranged at the end of the hinge arm facing away from the hinge axis. This tongue can be swung into a released position by pressing two lateral operating bars inwards. Close tolerances are not required during production of the lateral operating bars. In the hinge of the invention, the overall structure is simpler.

An exemplary embodiment of the furniture hinge according to the invention is illustrated in the drawings and is described below. In the drawings.

Figure 1:
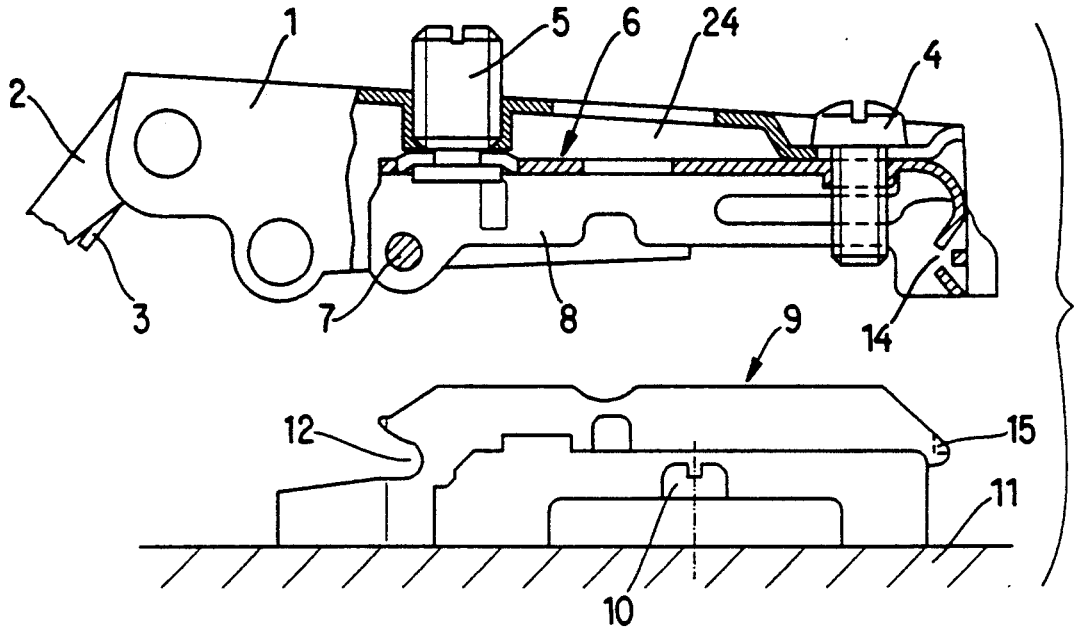
FIG. 1 is a side view, partly in section, of a hinge arm with an intermediate part secured thereto, an associated mounting plate, also being illustrated.

The hinge arm 1 is connected, via lateral hinge bars 2,3, with a non-illustrated hinge component which is attached to a lid, a door or the like.

In the illustrated exemplary embodiment, the hinge arm 1 is connected with an intermediate part 6 by means of a fastening screw 4 and an adjusting screw 5. The intermediate part 6 has a bolt 7 at the side facing the hinge axis of the hinge. The bolt 7 is fixed in the lateral legs 8 of the intermediate part which is U-shaped in cross section.

Figure 2:
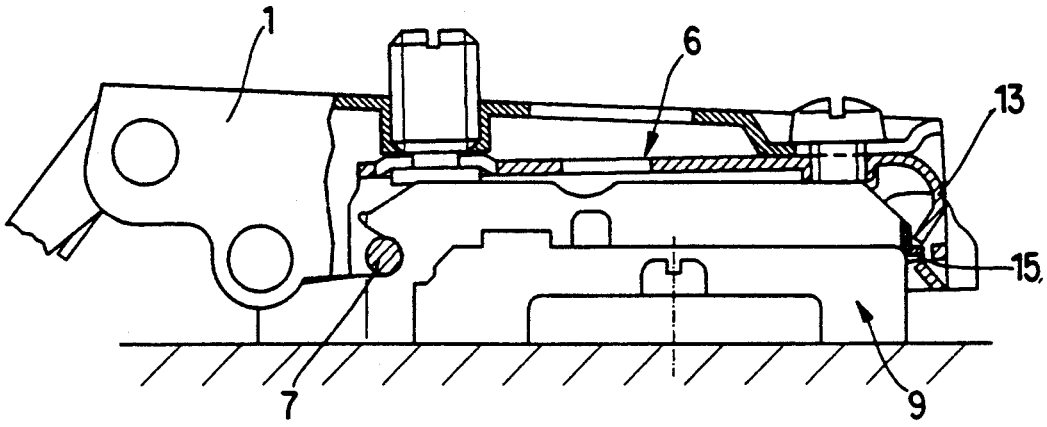
FIG. 2 shows the components of FIG. 1 in assembled condition.
Figure 3:
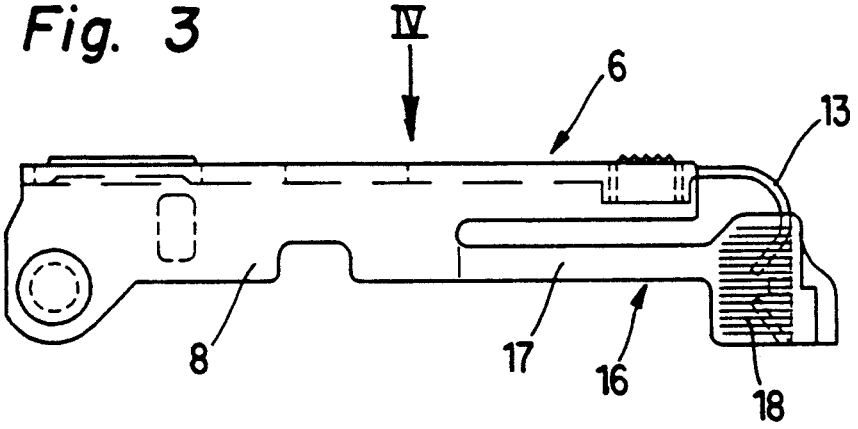
FIG. 3 is a side view of the intermediate part shown in FIGS. 1 and 2.

The mounting plate 9, which is fixed to a furniture wall 11 via fastening screws 10, has a bearing recess 12 at the side facing the hinge axis of the furniture hinge. As seen from FIG. 2, the bolt 7 is engaged in the bearing recess 12 in a formfitting manner so that the bearing recess 12 and the bolt 7 define a first bearing location At the front side facing away from the hinge axis of the furniture hinge, the intermediate part 6 is equipped with a resilient tongue 13 which, in the exemplary embodiment, is integral with the intermediate part 6 and has an arresting groove 14. An arresting ledge 15 of the mounting plate 9 catches in the arresting groove 14 in the course of the movement undergone by the intermediate part, or the hinge arm equipped with the intermediate part, during assembly. The arresting groove 14 an arresting ledge 15 constitute cooperating coupling portions for releasably connecting the intermediate part 6, or the assembly of the intermediate part 6 and the hinge arm 1, to the mounting plate 9.

To connect the hinge arm 1 and the intermediate part with the mounting plate 9, the bolt 7 of the unit illustrated in FIG. 1 and consisting of the hinge arm 1 and the intermediate part 6 is first engaged in the bearing recess 12 of the mounting plate 9. The unit consisting of the hinge arm and the intermediate part is then pivoted clockwise about this bearing until the arresting groove 14 receives the arresting ledge 15 of the mounting plate 9.

In the illustrated exemplary embodiment, lateral operating bars 16 engaging the tongue 13 from the side and connected with the intermediate part 6 are associated with the tongue 13. These lateral operating bars are formed from the lateral legs 8 of the intermediate part 6, and each has a narrow arm 17 which leads to a wide gripping portion 18.

An arm actuating portion 19 extends inwards from this gripping portion to the tongue 13.

Figure 4:
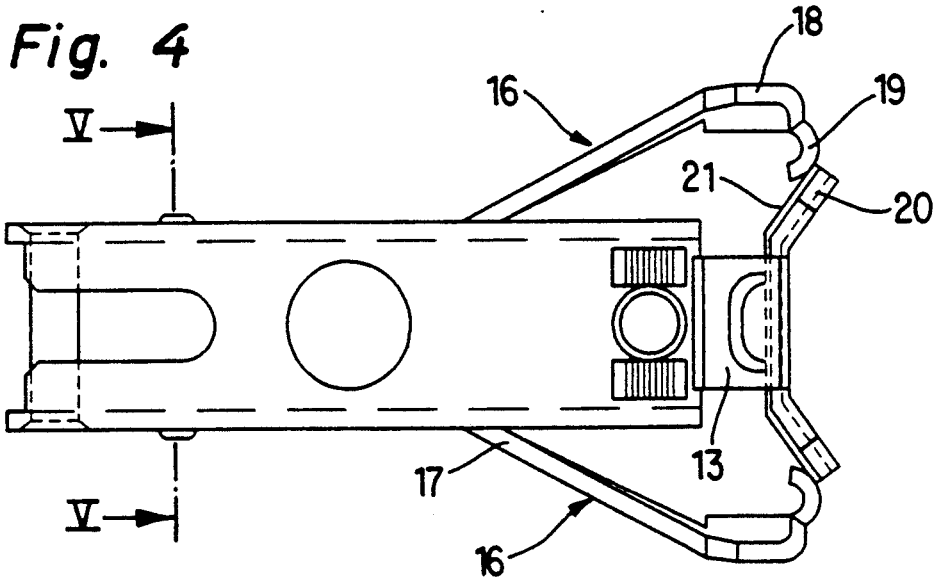
FIG. 4 is a view in the direction of the arrow IV in FIG. 3.
Figure 5:
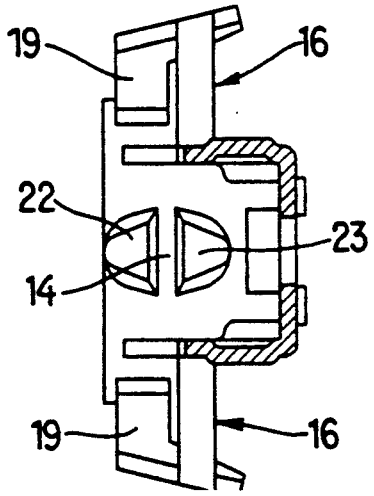
FIG. 5 is a section along the line V—V of FIG. 4.

In the exemplary embodiment, the tongue 13 is provided with rearwardly inclined end portions 20, and the arms 19 of the lateral operating bars 16 cooperate with the bounding surfaces 21 of the rearwardly inclined end portions 20 facing the hinge axis. As seen from FIG. 4, the arms 19 are inwardly arc-shaped.

In the exemplary embodiment, the arresting groove 14 is bounded by two indentations 22,23 which are arranged at a spacing one above the other.

The arresting connection between the tongue 13 and the mounting plate 9 can be broken by pressing the lateral operating bars inwards. The resilient tongue 13 is then elastically deformed, and is brought into a released position, by the arms 19 which cooperate with this tongue. The arms 17, gripping portions 18 and arms 19 thus constitute a means for disengaging the intermediate part 6, or the assembly of the intermediate part 6 and the hinge arm 1, from the mounting plate 9.

Subsequently, the hinge arm, together with the intermediate part, can be pivoted counterclockwise about the bolt 7. The hinge arm, together with the intermediate part, can then be separated from the mounting plate.

The tongue 13 equipped with arresting means defines a second bearing location together with the arresting ledge 15 of the mounting plate 9.

In the illustrated and described exemplary embodiment, the tongue 13 is integral with the intermediate part.

Figure 6:
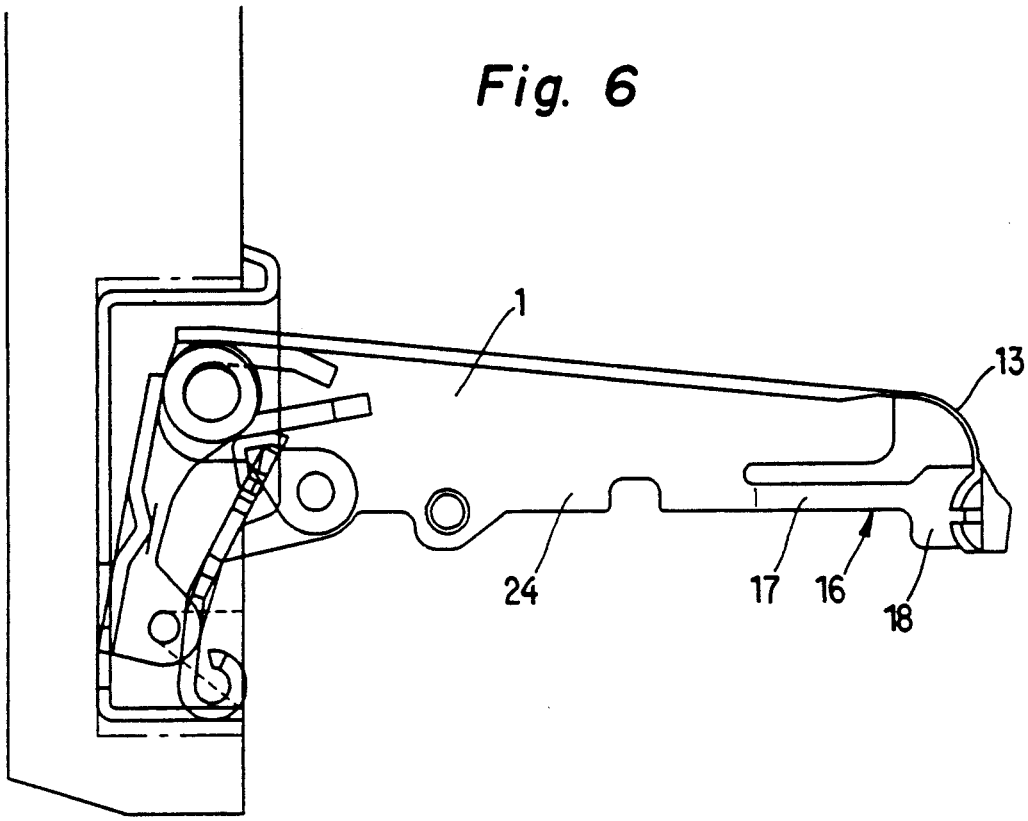
FIG. 6 is a view similar to that of FIG. 3 of a second embodiment of the hinge arm.
Figure 7:
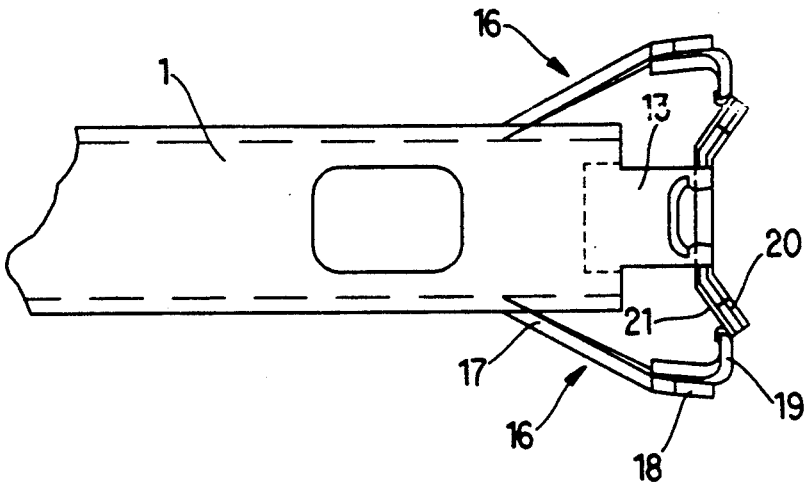
FIG. 7 is a view similar to that of FIG. 4 of the second embodiment of the hinge arm.

In a modified arrangement of this construction, it is also possible to provide the tongue on the hinge arm 1 and to form the lateral operating bars, which are associated with the tongue, from the lateral legs 24 of the hinge arm 1. This is shown in FIGS. 6 and 7.

We claim:

1. A hinge, particularly a furniture hinge, comprising a mount; and a hinge unit releasably connectible to said mount and having a hinge axis, said hinge unit being provided with a resilient tongue-like element constituting a sole resilient tongue-like element of said hinge unit, and said tongue-like element and said mount having cooperating coupling portions for releasably connecting said hinge unit to said mount, said hinge unit further being provided with disengaging means arranged to bear against is tongue-like element from the side an to elastically deform said tongue-like element so as to disengage said tongue-like element coupling portion from said mount coupling portion.

2. The hinge of claim 1 wherein said disengaging means comprises a pair of disengaging elements arranged to bear against said tongue-like element form opposite sides of said tongue-like element.

3. The hinge of claim 1, wherein said hinge unit has two ends, said hinge axis being located in the region of one of said ends and said tongue-like element being located in the region of the other of said ends.

4. The hinge of claim 1, wherein said hinge unit comprises a hinge arm, and means for adjusting said hinge arm with respect to said mount.

5. The hinge of claim 1, wherein said mount comprises a first mounting portion and said hinge unit comprises a complementary second mounting portion arranged to cooperate with said first mounting portion so as to hold said hinge unit on said mount, said hinge unit being elongated, and said second mounting portion being spaced form the coupling portion of said tongue-like element longitudinally of said hinge unit.

6. The hinge of claim 1, wherein said hinge unit comprises a hinge arm and said tongue-like element and disengaging means are provided on said hinge arm.

7. The hinge of claim 1, wherein said hinge unit comprises a hinge arm, and a support for said hinge arm, said tongue-like element and disengaging means being provided on said support.

8. The hinge of claim 1, wherein said tongue-like element is integral with said hinge unit.

9. The hinge of claim 1, wherein said hinge unit comprises a generally U-shaped component having a pair of legs, said disengaging means including a pair of disengaging elements, and at least part of each disengaging element being formed form a respective one of said legs.

10. The hinge of claim 9, wherein said hinge unit is elongated and said part of said disengaging elements extend generally in longitudinal direction of said hinge unit.

11. The hinge of claim 1, wherein said disengaging means comprises at lest one disengaging element which includes a strip-like portion projecting laterally of said hinge unit, a gripping portion mounted on said strip-like portion laterally of said hinge unit, and an actuating portion extending form said gripping portion towards said tongue-like element.

12. The hinge of claim 11, wherein said strip-like portion has a first width and said gripping portion has a second width greater than said first width.

13. The hinge of claim 1, wherein said tongue-like element is provided with at least one laterally projecting inclined portion, said disengaging means cooperating with said inclined portion.

14. The hinge of claim 1, wherein said coupling portions include a slot on said tongue-like element and a projection on said mount.

15. The hinge of claim 14, wherein said tongue-like element is provided with a pair of aligned and spaced indentations, said indentations flanking said slot.

16. The hinge of claim 1, wherein said disengaging means projects laterally of said hinge unit.

17. A hinge, particularly a furniture hinge, comprising a mount; and a hinge unit releasably connectible to said mount and having a hinge axis, said hinge unit being provided with a resilient tongue-like element, and said tongue-like element and said mount having cooperating coupling portions for releasably connecting said hinge unit to said mount, said hinge unit further being provided with disengaging means arranged to bear against said tongue-like element from the side and to elastically deform said tongue-like element so as to disengage said tongue-like element coupling portion from said mount coupling portion, said tongue-like element including at least one laterally projecting inclined portion which extends form said tongue-like element in a direction away from, and has a surface facing, said hinge axis, and said disengaging means projecting laterally of and cooperating with said inclined portion, said disengaging means including an actuating portion which extends towards said inclined portion and is arranged to cooperate with said surface.

* * * * *